US007306330B2

(12) United States Patent
Ikezaki

(10) Patent No.: US 7,306,330 B2
(45) Date of Patent: Dec. 11, 2007

(54) INKJET PRINTER

(75) Inventor: Yoshiyuki Ikezaki, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 10/808,867

(22) Filed: Mar. 25, 2004

(65) Prior Publication Data

US 2004/0189753 A1 Sep. 30, 2004

(30) Foreign Application Priority Data

Mar. 26, 2003 (JP) ..... 2003-084514

(51) Int. Cl.
*B41J 2/175* (2006.01)
*B41J 2/14* (2006.01)

(52) U.S. Cl. ..... 347/86; 347/49

(58) Field of Classification Search ..... 347/84, 347/85, 86, 87

See application file for complete search history.

(56) References Cited

U.S. PATENT DOCUMENTS 4,631,558 A * 12/1986 Hara ..... 347/86
6,164,766 A * 12/2000 Erickson ..... 347/85
6,170,941 B1 * 1/2001 Hara et al. ..... 347/86
6,206,513 B1 * 3/2001 Tajima et al. ..... 347/86
6,238,042 B1 * 5/2001 Kobayashi et al. ..... 347/86
6,247,803 B1 * 6/2001 Kanaya et al. ..... 347/86
6,634,738 B1 * 10/2003 Shinada et al. ..... 347/86
6,955,425 B2 * 10/2005 Childs et al. ..... 347/89

FOREIGN PATENT DOCUMENTS

| | | |
|---|---|---|
| JP | 5201015 | 8/1993 |
| JP | 10329330 | 12/1998 |
| JP | 2001328279 | 11/2001 |
| JP | 2002144600 | 5/2002 |
| JP | 2002166567 | 6/2002 |
| JP | 2002166568 | 6/2002 |
| JP | 2002172797 | 6/2002 |
| JP | 2002205413 | 7/2002 |

* cited by examiner

*Primary Examiner*—Anh T. N. Vo
(74) *Attorney, Agent, or Firm*—Day Pitney LLP

(57) ABSTRACT

An inkjet printer has an inkjet head, a carriage and a movable ink tank mounted, together with the inkjet head, on the carriage. The movable tank having an ink storing chamber which is divided in the horizontal direction, into a plurality of rooms. The plurality of rooms communicate with each other at upper portions which are above an upper end of at least one wall extending vertically. A horizontal cross-sectional area of at least one room, which is not provided with an ink introducing channel, within a predetermined vertical range from the upper end of the at least one wall is equal to or smaller than that of a room provided with the ink introducing channel.

20 Claims, 8 Drawing Sheets

INKJET PRINTER

BACKGROUND OF THE INVENTION

The present invention relates to an inkjet printer that ejects ink on a recording medium to print an image thereon.

There has been known a so-called serial type inkjet printer. In the serial type inkjet printer, an inkjet head is mounted on a carriage that reciprocates in a direction perpendicular to a feeding direction of a recording sheet (i.e., in a width direction of the recording sheet). A tube is connected to the ink head to supply ink from an ink supplying source. The inkjet head ejects the ink supplied from the ink supplying source to print a desired image on the recording sheet. When the image is printed, the inkjet head ejects the ink while the carriage is reciprocating.

When the carriage changes its moving directions, relatively large acceleration acts on the inkjet head. Then, a large acceleration acts on the inkjet head and the tube connecting the inkjet head with the ink supplying source. This large acceleration generates dynamic pressure in the ink within the tube. The dynamic pressure may transmit to the inkjet head and make the ink ejection unstable.

In order to overcome the problems mentioned above, an inkjet printer disclosed in Japanese Patent Application Provisional Publication No. P2002-166568 employs a sub-tank that is divided into a first ink room and a second ink room. The first ink room is supplied with ink from an ink cartridge through a tube and has an air space for accumulating the bubbles introduced into the first ink room. The second ink room is in fluid communication with an inkjet head to supply ink thereinto. The first and second ink rooms are connected with each other at upper portions thereof to allow ink to flow from the first ink room into the second ink room. A filter is provided between the first and second ink rooms to trap the bubbles in the ink.

In the above-mentioned sub-tank, the air accumulated in the air space defined above the first ink room absorbs the dynamic pressure generated in the ink by the reciprocation of the carriage, resulting in a stable ink ejection from the inkjet head and hence a good printing quality.

In the above-mentioned sub-tank, however, the surface of the ink exposed to the air accumulated in the first ink room increases as the volume of the accumulated air increases and the level of the ink comes down. The increase of the ink surface causes coagulation of the materials contained in the ink, which inhibits smooth flow of the ink.

SUMMARY OF THE INVENTION

The present invention is advantageous in that an inkjet printer is provided, in which coagulation of the adhesive material in ink within a sub-tank for supplying the ink to an inkjet head can be effectively reduced.

According to an aspect of the invention, there is provided an inkjet printer provided with an inkjet head that is driven to eject ink to a recording medium, a carriage mounting the inkjet head, the carriage being reciprocally movable in a second direction which is perpendicular to the first direction, a movable ink tank that is mounted on the carriage, the movable tank having an ink storing chamber, the ink tank having an ink introducing channel and an ink discharging opening, ink supplied through the ink introducing channel being stored in the ink storing chamber, the ink stored in the ink storing chamber being discharged through the ink discharging opening to the inkjet head, and at least one wall provided in the ink chamber, the at least one wall extending vertically to divide the ink chamber, in the horizontal direction, into a plurality of rooms, the plurality of rooms communicating with each other at upper portions which are above an upper end of the at least one wall, a first room, which is one of the plurality of rooms, being provided with the ink introducing channel.

With this structure, a horizontal cross-sectional area of at least one second room, which one of the plurality of rooms other than the first room, within a predetermined vertical range from the upper end of the at least one wall is equal to or smaller than that of the first room.

The inkjet printer described above is advantageous in that coagulation of the adhesive material included in ink within a ink chamber for supplying the ink to an inkjet head can be effectively reduced.

Optionally, a horizontal cross-sectional area of the at least one second room below the predetermined vertical range may be greater than the horizontal cross-sectional area thereof within the predetermined vertical range.

Further, horizontal cross-sectional areas of the plurality of the rooms other than the first room within a predetermined vertical range from the upper ends of the at least one wall may be equal to or smaller than that of the first room.

Furthermore, horizontal cross-sectional areas of the plurality of the rooms other than the first room below the predetermined vertical range may be greater than the horizontal cross-sectional areas thereof within the predetermined vertical range.

Optionally, at least one room of the plurality of the rooms other than the first room may have a vertical range, in the vicinity of the upper end of the at least one wall, in which the horizontal cross-sectional area is fixed.

Still optionally, the at least one second room may have a vertical range, below the predetermined vertical range, in which the horizontal cross-sectional area increases toward a lower portion thereof.

Further optionally, at least one of the plurality of the rooms other than the first room may have a vertical range, above the upper end of the at least one wall, in which a horizontal cross-sectional area is greater than that in the predetermined vertical range.

Optionally, the inkjet printer may further include a stationary ink tank which does not move when the carriage moves, and a tube member that connects the stationary ink tank and the movable ink tank to allow the ink to be supplied from the stationary ink tank to the movable ink tank.

Still optionally, each of the at least one wall may have a portion extending in directions substantially perpendicular to the first direction.

In a particular case, a portion of a side wall of the first room facing the portion extending in directions substantially perpendicular to the first direction may be formed with flexible material.

Further optionally, the at least one wall may consist of a single wall, the ink chamber being divided into two rooms by the single wall.

Optionally, a horizontal cross-sectional area of the first room below the predetermined vertical range may be greater than the horizontal cross-sectional area thereof within the predetermined vertical range.

In this case, the first room may have a vertical range, in the vicinity of the upper end of the at least one wall, in which the horizontal cross-sectional area is fixed.

Furthermore, the first room may have a vertical range, below the predetermined vertical range, in which the horizontal cross-sectional area increases toward a lower portion thereof.

Still optionally, the first room may have a vertical range, above the upper end of the at least one wall, in which a horizontal cross-sectional area is greater than that in the predetermined vertical range.

Further optionally, the inkjet printer may further include a stationary ink tank which does not move when the carriage moves, and a tube member that connects the stationary ink tank and the movable ink tank to allow the ink to be supplied from the stationary ink tank to the movable ink tank.

Further, each of the at least one wall may have a portion extending in directions substantially perpendicular to the first direction.

In a particular case, a portion of a side wall of the first room facing the portion extending in directions substantially perpendicular to the first direction may be formed with flexible material.

According to another aspect of the invention, there is provided an inkjet printer printing an image on a recording medium which is fed in a first direction, which is provided with an inkjet head that is driven to eject ink to a recording medium, a carriage mounting the inkjet head, the carriage being reciprocally movable in a second direction which is perpendicular to the first direction, a movable ink tank that is mounted on the carriage, the movable tank having an ink storing chamber, the ink tank having an ink introducing channel and an ink discharging opening, ink supplied through the ink introducing channel being stored in the ink storing chamber, the ink stored in the ink storing chamber being discharged through the Ink discharging opening to the inkjet head, and at least one wall provided in the ink chamber, the at least one wall extending vertically to divide the ink chamber, in the horizontal direction, into a plurality of rooms, the plurality of rooms communicating with each other at an portion of the ink chamber which is above an upper end of the at least one wall.

With this configuration, the upper portion of the ink chamber includes a first vertical range above the upper end of the at least one wall and a second vertical range above the first vertical area, a horizontal cross-sectional area in the second vertical range is smaller than that in the first vertical range.

According to a further aspect of the invention, there is provided an inkjet printer printing an image on a recording medium which is fed in a first direction, which is provided with an inkjet head that is driven to eject ink to a recording medium, a carriage mounting the inkjet head, the carriage being reciprocally movable in a second direction which is perpendicular to the first direction, a movable ink tank that is mounted on the carriage, the movable tank having an ink storing chamber, the ink tank having an ink introducing channel and an ink discharging opening, ink supplied through the ink introducing channel being stored in the ink storing chamber, the ink stored in the ink storing chamber being discharged through the ink discharging opening to the inkjet head, and at least one wall provided in the ink chamber, the at least one wall extending vertically to divide the ink chamber, in the horizontal direction, into a plurality of rooms, the plurality of rooms communicating with each other at upper portions which are above an upper end of the at least one wall, one of the plurality of rooms being provided with the ink introducing channel. With this configuration, a horizontal cross-sectional area of at least one of the plurality of rooms within a predetermined vertical range from the upper end of the at least one wall is less than that at a range below the predetermined vertical range.

BRIEF DESCRIPTION OF THE ACCOMPANYING DRAWINGS

FIG. 1 schematically illustrates a configuration of an inkjet printer 1 according to an embodiment of the invention;

FIGS. 2A and 2B schematically illustrates a configuration for supplying ink to the inkjet head 5;

Figure 4A:
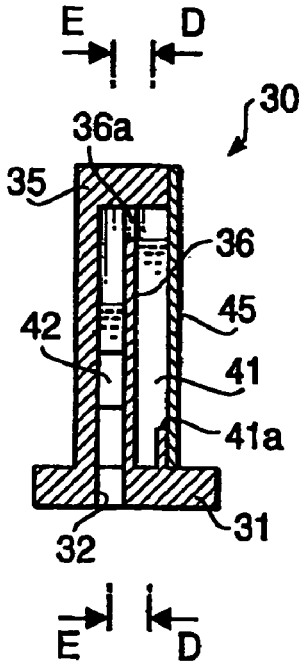
Figure 4B:
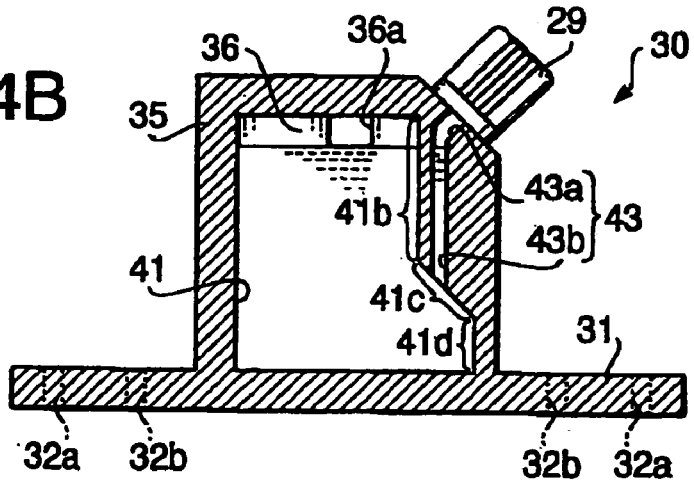
Figure 4C:
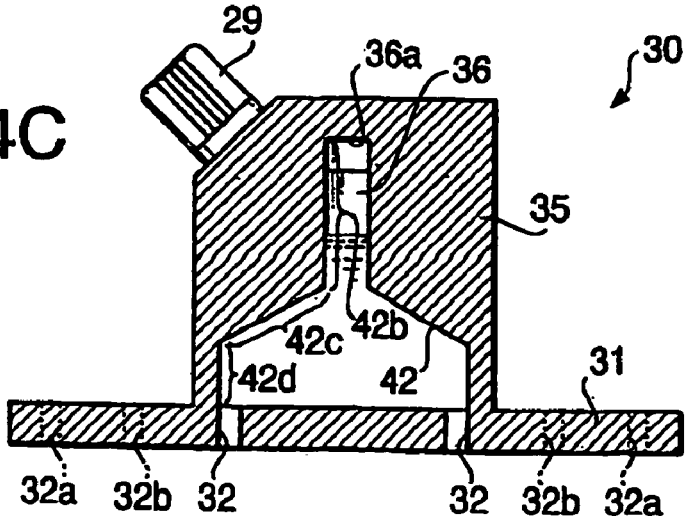
Figure 5A:
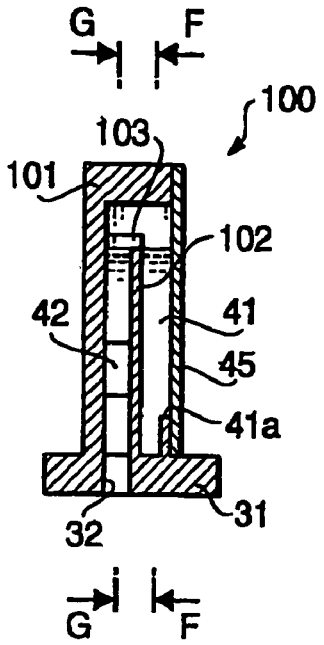
Figure 5B:
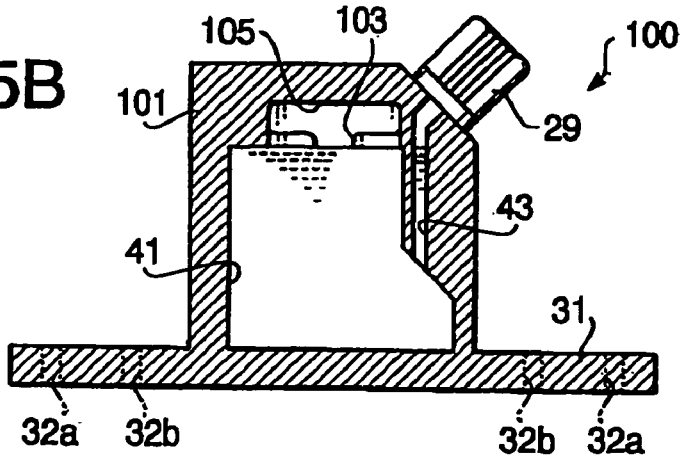
Figure 5C:
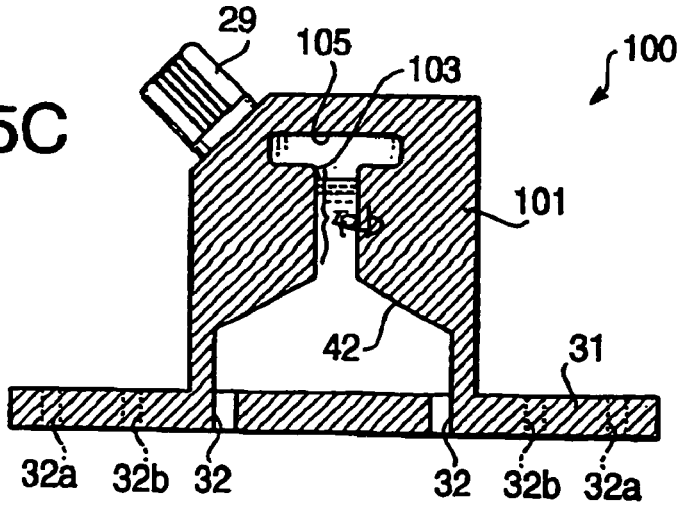
Figure 6A:
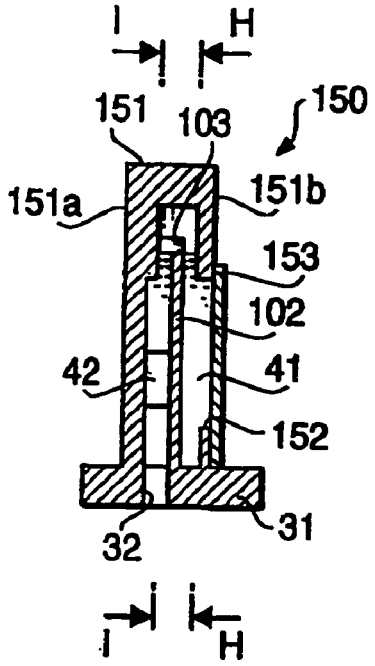
Figure 6B:
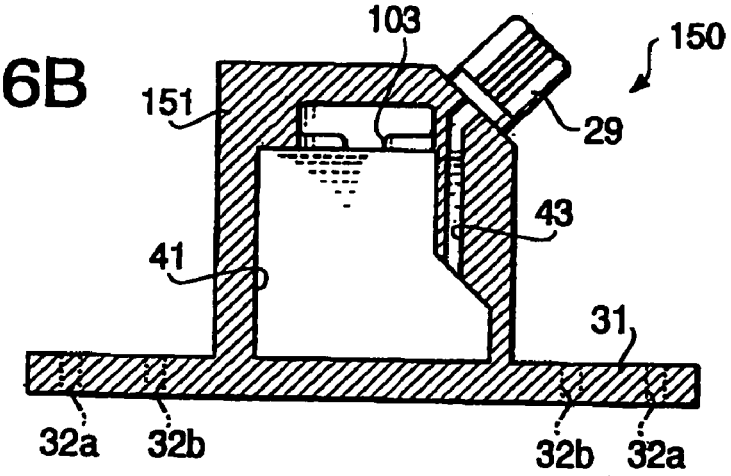
Figure 6C:
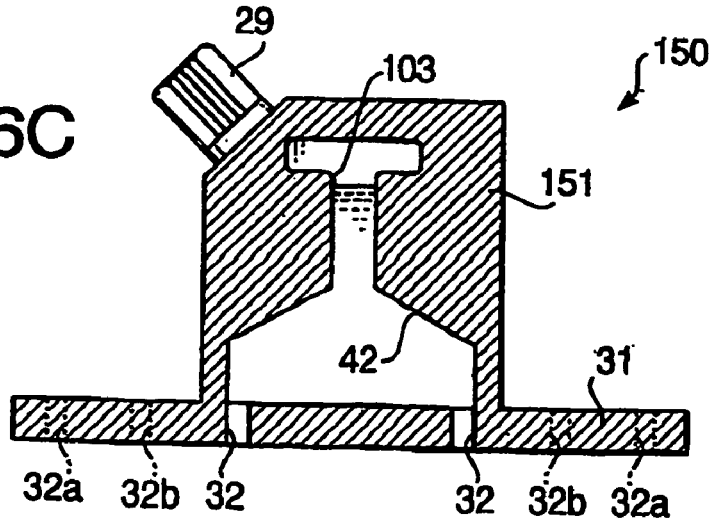
Figure 7A:
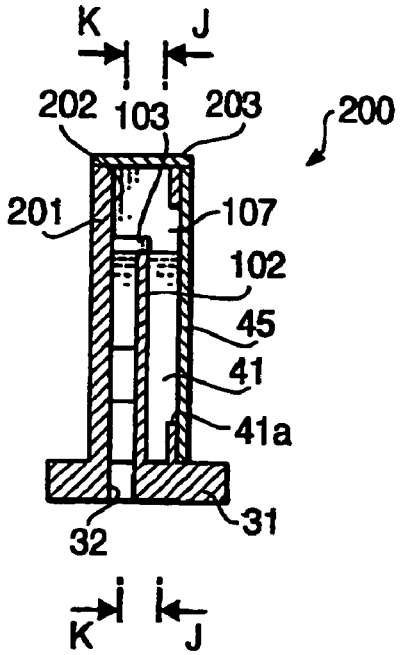
Figure 7B:
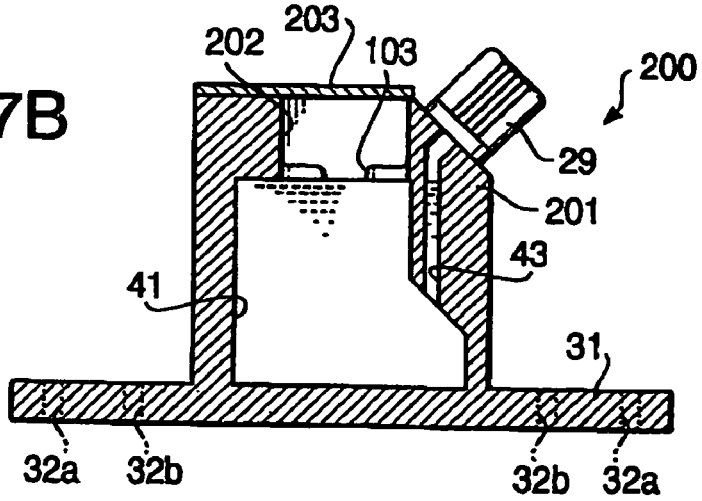
Figure 7C:
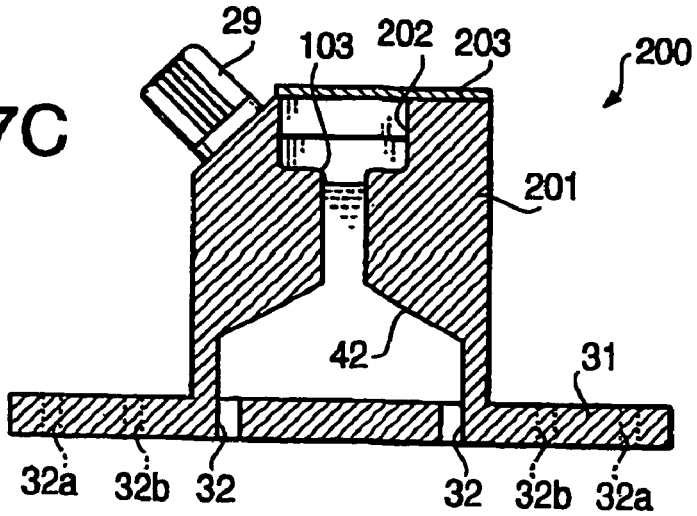
Figure 8A:
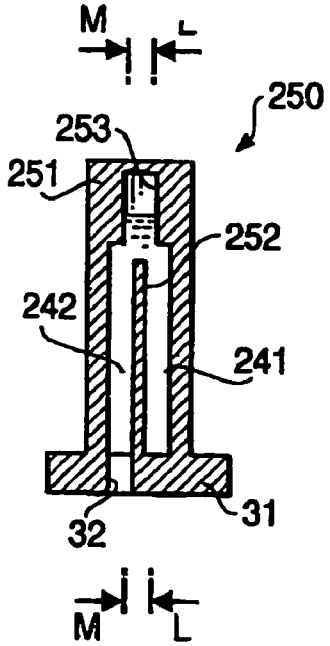
Figure 8B:
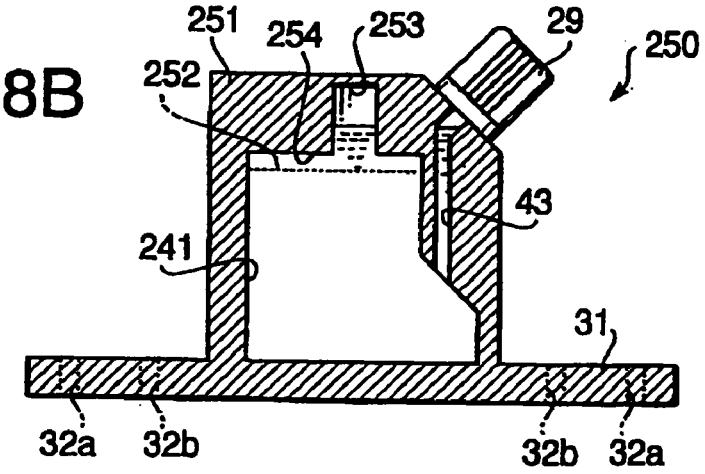
Figure 8C:
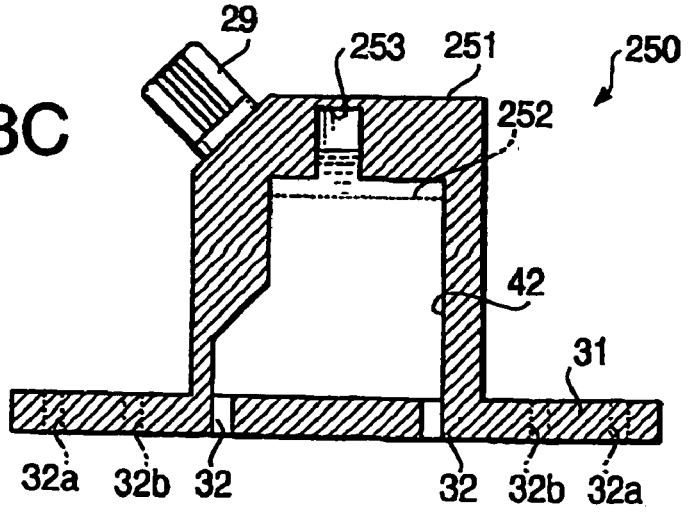

FIG. 4A schematically illustrates the state of the ink within the sub-tank after printing or purging is carried out since the air within the sub-tank has increased due to the Introduction of ink containing bubbles;

FIGS. 4B and 4C are sectional views of the sub-tank taken along lines D-D and E-E in FIG. 4A, respectively;

FIG. 5A is a sectional view of a sub-tank according to a first variation of the embodiment;

FIGS. 5B and 5C are sectional views of the sub-tank taken along lines F-F and G-G in FIG. 5A, respectively;

FIG. 6A is a sectional view of a sub-tank according to a second variation of the embodiment;

FIGS. 6B and 6C are sectional views of the sub-tank taken along lines H-H and I-I in FIG. 6A, respectively;

FIG. 7A is a sectional view of a sub-tank according to a third variation of the embodiment;

FIGS. 7B and 7C are sectional views of the sub-tank taken along lines J-J and K-K in FIG. 7A, respectively;

FIG. 8A is a sectional view of a sub-tank according to a fourth variation of the embodiment; and FIGS. 8B and 8C are sectional views of the sub-tank taken along lines L-L and H-H in FIG. 8A, respectively.

DETAILED DESCRIPTION OF THE EMBODIMENTS

Hereinafter, an embodiment of the present invention will be described with reference to the accompanying drawings.

Configuration of the Printer

Figure 1:
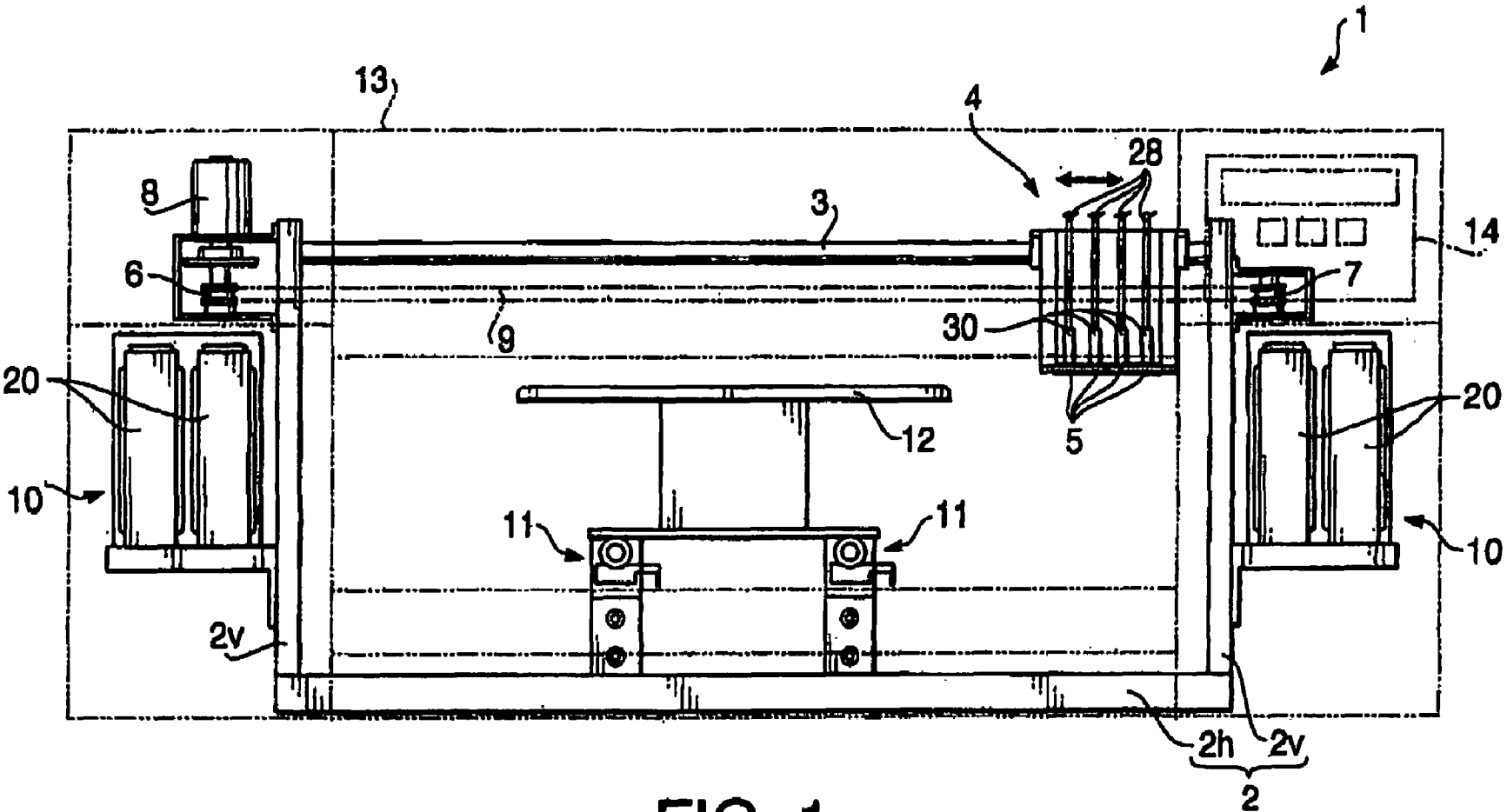

FIG. 1 schematically illustrates a configuration of the inkjet printer 1 according to an embodiment of the invention. As shown in FIG. 1, the inkjet printer 1 includes a frame 2 provided on a casing (which is schematically illustrated by chain double-dashed lines). The frame 2 includes a horizontal portion 2*h* disposed on the bottom of the inkjet printer 1 and vertical portions 2*v* extending perpendicularly to and upward from both sides of the horizontal portion 2*h*.

A slide rail 3 is horizontally supported by the vertical portions 2*v* to extend between the upper ends of the vertical portions 2*v*. A carriage 4 is mounted on the slide rail 3 slidably in a longitudinal direction of the slide rail 3, or a main scanning direction of the inkjet printer 1. Four piezoelectric inkjet heads 5 are mounted on an undersurface of the carriage 4. Each inkjet head 5 corresponds to an ink of a different color.

The vertical portions 2*v* support a pair of pulleys (6, 7) at the upper portions thereof. One of the pulleys (6) is coupled to a spindle of a motor 8 supported by the same vertical portion 2*v*. An endless belt 9 is wound around the pulleys 6 and 7. The carriage 4 is coupled with this endless belt 9.

In the inkjet printer 1 arranged as above, the carriage 4 reciprocates linearly along the slide rail 3 as the motor 8 rotates the pulley 6 in normal and reverse directions. As a result, the inkjet heads 5 moves back and forth in the main scanning direction.

Each vertical portion 2*v* is provided with a mounting portion 10, on which ink tanks (stationary ink tanks) 20 are detachably mounted. Each mounting portion 10 is configured to hold two ink tanks 20. The four ink tanks 20 contain ink of different colors.

Figure 2A:
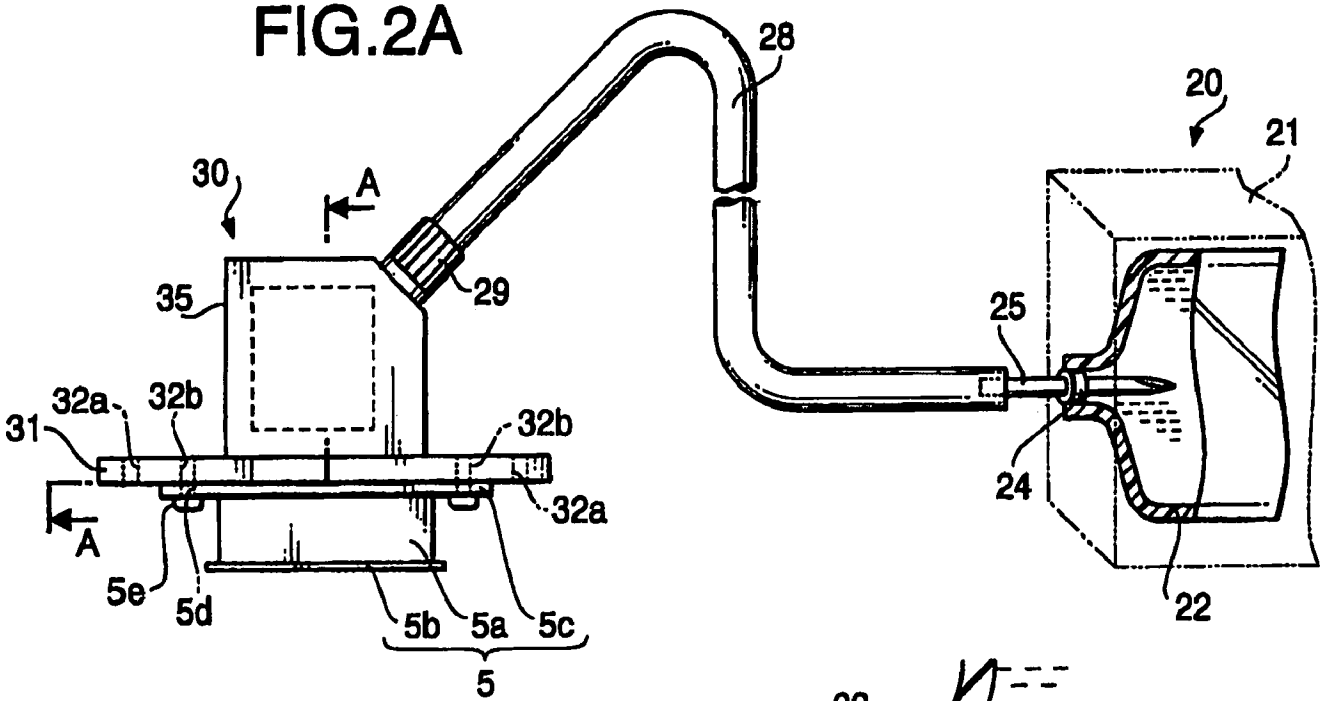

Each ink tank 20 includes an ink bag 22 (see FIG. 2A). The ink bags 22 of the ink tanks 20 are connected, by flexible tubes 28, to respective ones of the four sub-tanks (movable ink tanks) 30 disposed above respective inkjet heads 5. The sub-tanks 30 are in fluid communication with respective inkjet heads 5. as will be describe later. Thus, ink can be supplied from the ink tanks 20 to the inkjet heads 5 through the sub-tanks 30.

As shown in FIG. 1, a slide mechanism 11 is provided on the horizontal portion 2*h* of the frame 2. The slide mechanism 11 supports a platen 12 thereon. The platen 12 is arranged so that fabric can be spread flatly thereon without any wrinkles and with the side to be printed on the top. The inkjet printer 1 according to the present invention prints on a T-shirt, for example.

The inkjet printer 1 further includes a platen moving mechanism (not shown) for reciprocating the platen 12 in a direction perpendicular to a plane of FIG. 1 (i.e., a direction in which the slide mechanism 11 slides, or an auxiliary scanning direction of the inkjet printer 1). Although the platen moving mechanism is not shown, it should be noted that it may include a rack and pinion mechanism, an endless belt, or the like for driving the platen 12.

The inkjet printer 1 has a cover 13 for covering and thereby protecting the inkjet heads 5, the slide mechanism 11, and the like. Note that the cover 13 is illustrated by chain double-dashed lines, or imaginary lines, so that the configuration behind the cover 13 can be shown in detail. A front side of the cover 13 is provided with an operation panel 14, which includes a liquid crystal display and multiple operation buttons, at an upper part of a right-hand-side thereof in FIG. 1.

Configuration for Supplying Ink to Inkjet Head

FIG. 2A schematically illustrates a configuration for supplying ink to the inkjet head 5. As shown in FIG. 2A, the sub-tank 30 for storing the ink supplied from the ink tank 20 is disposed above the inkjet head 5. A connection portion 29 is formed on an upper portion of the right-hand-side of the sub-tank 30 in FIG. 2A. The connection portion 29 is connected with one end of the flexible tube 28. The other end of the flexible tube 28 is provided with a hollow needle 25 penetrating a cap 23 of the ink tank 20. Thus, the ink of the ink tank 20 can flow into the flexible tube 28 through the hollow needle 25.

By connecting the ink tank 20 and the sub-tank 30 with the flexible tube 28 as described above, the ink of the ink tank can be supplied to the sub-tank 30 while disposing the ink tank at a place where the ink tank can be exchanged with ease. Thus, in the present embodiment, the ink tank 20 can be exchanged easily when the ink tank 20 is empty.

Figure 2B:
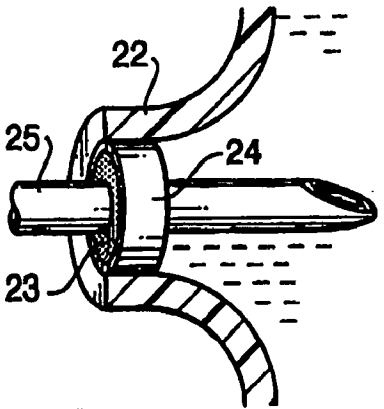

The ink tank 20 has a housing 21 made of synthetic resin. The ink bag 22 is provided in the housing 21 and contains degassed-ink. A spout 24 is provided at an opening of the ink bag 22, and secured thereto (see FIG. 2B, which is an enlarged view of around the cap 23). The spout 24 is a ring-shaped member formed of synthetic resin, and the cap 23 made of silicon rubber or Butyl-rubber is secured to the inner surface of the spout 24. The ink bag 22 is made of a pouched film obtained by bonding multiple flexible films by thermo compression. The pouched film has a laminated structure of a polyethylene resin layer, a polyester layer, an aluminum foil layer and a nylon layer, laminated in this order. The polyethylene resin layer serves as an innermost layer of the ink bag 22. The polyester layer serves as a base material layer. The aluminum foil layer is provided on the outer side of the polyester layer and serves as a gas barrier layer. The nylon layer, the outermost layer of the ink bag 22, is provided in order to enhance the strength of the pouched film.

As previously described, the hollow needle 25, which is provided on one end of the flexible tube 28, penetrates the cap 23. When the ink of the ink tank 20 is all consumed, the ink tank 20 can be exchanged with a new one by pulling off the hollow needle 25 from the cap 23.

The four inkjet heads 5 correspond to four colors (i.e., magenta, yellow, cyan, and black), respectively, and are arranged on the carriage 4, as shown in FIG. 1, along the direction in which the carriage 4 reciprocates. Further, the inkjet heads 5 are connected with respective ink tanks 20 through the flexible tubes 28 and the sub-tanks 30.

Each inkjet head 5 has an elongated rectangular shape when observed from above and is disposed so that a longitudinal direction thereof is perpendicular to the direction in which the carriage 4 reciprocates.

As shown in FIG. 2A, each inkjet head 5 has a head body 5*a* which includes a flow channel unit (in which ink flow channels and pressure chambers are formed) and an actuator bonded onto the flow channel unit to pressurize the ink within the pressure chambers. The bottom of the head body 5*a* is formed with a plurality of minute diameter ink ejecting nozzles for ejecting ink downward.

A cover 5*b* is provided on the bottom of the head body 5*a*, which prevents the ink ejecting nozzles from coming into contact with the fabric during printing. The cover 5*b* is a plate formed with a rectangular opening so that the cover 5*b* does not hinder ejection of ink from the head body 5*a*.

A mounting plate 5*c* is provided on the top surface of the head body 5*a*. Through holes 5*d* are formed at both side portions of the mounting plate 5*c* so that the mounting plate 5*c*, or the inkjet head 5, can be fixed on the bottom of the sub-tank 30 with screws 5*e*.

The inkjet heads 5 are supported by the carriage 4 so that a small gap is formed between the undersurface of the inkjet head 5 and the top surface of the platen 12 when the inkjet heads 5 are located above the platen 12. The gap allows the fabric to be placed on the platen 12 without contacting the inkjet heads 5 traveling across the platen 12. The fabric is set on the platen so that a portion thereof to be printed is placed on the top surface of the platen 12. The inkjet heads 5 are reciprocally moved across the platen 12 by the carriage 4 and eject ink onto the recording medium. Each inkjet head 5 ejects ink of different color so that a desired color image can be printed on the fabric.

Configuration of the Sub-tank

Figure 3A:
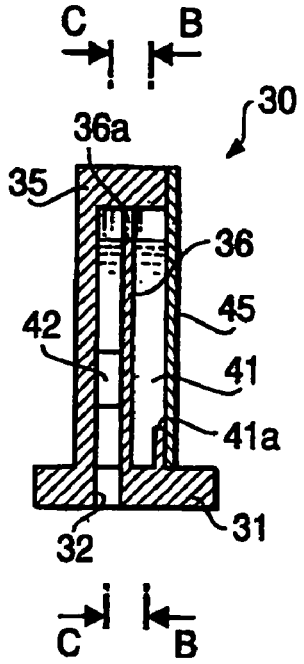
FIG. 3A is a sectional view of the sub-tank taken along a line A-A in FIG. 2A.
Figure 3B:
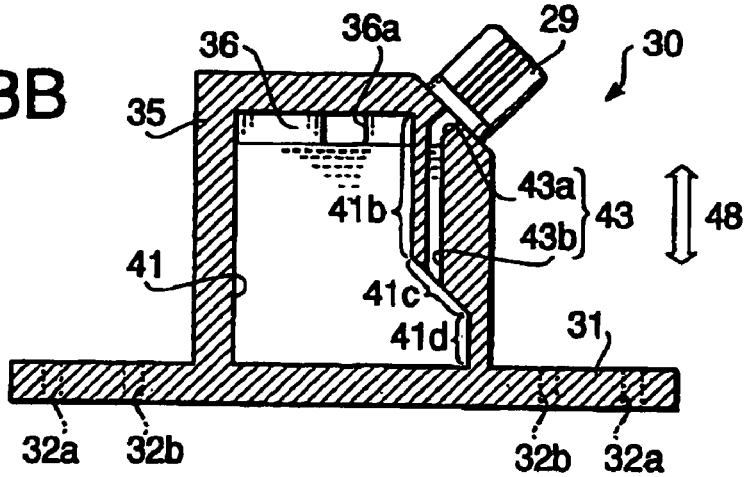
FIGS. 3B and 3C are sectional views of the sub-tank taken along lines B-B and C-C in FIG. 3A. respectively.
Figure 3C:
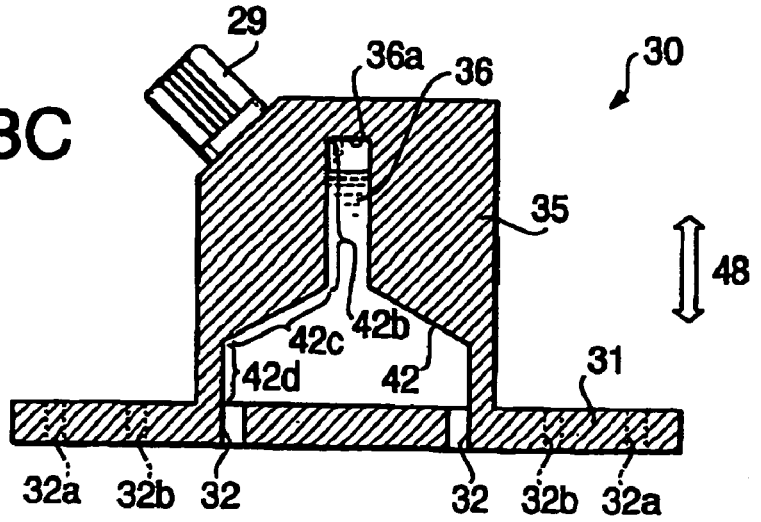

FIGS. 3A through 3C schematically show a configuration of the sub-tank 30. FIG. 3A is a sectional view of the sub-tank 30 taken along a line A-A in FIG. 2A. FIGS. 3B and 3C are sectional views of the sub-tank 30 taken along lines B-B and C-C in FIG. 3A, respectively.

The sub-tank 30 has a base plate 31 for fixing the sub-tank 30 on the carriage 4 and a body 35 formed into a substantially rectangular parallelepiped shape. The body 35 has an ink storing space (i.e., ink rooms 41, 42) therein for storing the ink supplied from the ink tank 20.

The base plate 31 has an elongated rectangular shape when observed from above. The sub-tank 30 is disposed on the carriage 4 such that a longitudinal direction of the base plate 31 is perpendicular to the reciprocating direction of the carriage 4. The base plate 31 is formed with through holes 32*a*, which allow the base plate 31 to be fixed on the carriage 4 by screws, and through holes 32*b* provided with screw threads on inner surfaces thereof. The screws 5*e* shown in FIG. 2A are screwed into the through holes 32*b* to fix the inkjet head 5 to the sub-tank 30.

As shown in FIG. 3A, a wall 36 is formed inside the body 35 to divide the ink storing space of the body 35 into a first ink room 41 and a second ink room 42. The wall 36 is formed on the base plate 31 and extends perpendicularly to the moving direction of the carriage 4. An opening 36*a* is formed on the wall 36 at the upper end thereof. The first and second ink rooms 41 and 42 are in fluid communication with each other at the upper end portions thereof through the opening 36*a*.

The first ink room 41 has a side wall facing the wall 36 and having an opening 41*a*. The opening 41*a* is covered, or closed, by a flexible film (flexible member) 45. The flexible film 45 is a two layer film in which a polyethylene terephthalate resin layer and polypropylene resin layer are laminated. The polypropylene resin layer is 30 μm thick and the polyethylene terephthalate resin layer is 10 μm thick. Silicon dioxide is deposited on a side of the polyethylene terephthalate resin layer. The silicon dioxide layer formed on the polyethylene terephthalate resin layer serves as an air shielding layer that prevents air and vapor from entering the sub-tank 30 through the flexible film 45.

It should be noted that the body 35 of the sub-tank 30 is made of polypropylene resin. The flexible film 45 is disposed such that the polypropylene resin layer faces the body 35 and is fixed on the side wall of the body 35 by thermo compressing. Since the material of the body 35 and the material of the layer of the flexible film 45 facing the body 35 are the same, a large bonding force between the body 35 and the flexible film 45 can be obtained.

It should be noted that when the body 35 is made of polyethylene resin, it is preferable that the layer of the flexible film 45 facing the body 35 is also made of polyethylene resin, i.e. the same material as the body 35. With this, the bonding force between the body 35 and the flexible film 45 can be increased.

As shown in FIG. 3B, the sub-tank 30 has an ink introducing channel 43 that connects the connection portion 29 and a lower part of the first ink room 41. When the connection portion 29 is connected with the flexible tube 28, the ink introducing channel 43 is in fluid communication with the flexible tube 28. The ink introducing channel 43 is bent near the connection portion 29 to form an inclined portion 43*a* extending toward the connection portion 29 and a vertical portion 43*b* extending vertically downward. The lower end of the vertical portion 43*b* is in fluid communication with the first ink room 41 at a position lower than the upper edge of the wall 36 or the opening 36*a*. The ink introducing channel 43 Is formed parallel to the wall 36 so that the ink is introduced into the first ink room 41 in parallel with the wall 36.

As shown in FIG. 3C, two ink discharging openings 32 for discharging the ink stored in the second ink room 42 into the inkjet head 5 are formed on the base plate 31. The ink discharging openings 32 are formed at locations corresponding to ink supply openings (not shown) of the inkjet head 5.

The first ink room 41 has an upper part 41*b*, a middle part 41*c*, and a lower part 41*d*. The upper part 41*b* extends from the top of the first ink room 41 to a position slightly higher than the lower end of the ink introducing channel 43. The upper part 41*b* is formed such that the horizontal section thereof (which is the section parallel to the base plate 31) does not substantially vary in a vertical direction (a direction perpendicular to the base plate 31, indicated by a double headed arrow 48 in FIG. 3B). The middle part 41*c* extends from the lower end of the upper part 41*b* to a position slightly lower than the lower end of the ink introducing channel 43. The middle part 41*c* is formed such that the horizontal section thereof gradually increases toward the lower part 41*d*. The rest of the first ink room 41 is the lower part 41*d* of which horizontal section is substantially the same in the vertical direction.

As shown in FIG. 3C, the second ink room 42 has an upper part 42*b*, a middle part 42*c*, and a lower part 42*d*. The upper part 42*b* extends from the top of the second ink room 42 to a vicinity of the middle thereof in the vertical direction and has a substantially constant horizontal section in the vertical direction. The upper part 42*b* is formed such that the horizontal section thereof does not substantially vary in a vertical direction (a direction perpendicular to the base plate 31, indicated by a double headed arrow 48 in FIG. 3C). The middle part 42*c* extends downward from the lower end of the upper part 42*b* with an increasing horizontal section. The lower part 42*d* extends downward from the lower end of the middle part 42*c*. The horizontal section of the lower part 42*d* is constant in the vertical direction, which horizontal section is substantially the same as the horizontal section of the lower part 41*d* of the first ink room 41.

The upper and middle parts (42*b*, 42*c*) of the second ink room 42 have smaller horizontal sections than the upper and middle parts (41*b*, 41*c*) of the first ink room 41, respectively. Since the upper part 42*b* of the second ink room 42 is formed with a small horizontal section, the surface area of the ink exposed to the air within the sub-tank 30 is small. Thus, coagulation of the adhesive materials contained in the ink due to the exposure of the ink to air can be reduced. The coagulation may prevent the ink from flowing toward the inkjet head 5.

The middle and lower parts (41*c*, 41*d*, 42*c*, 42*d*) of the first and second ink rooms 41 and 42, of which horizontal sections are expanded relative to the upper parts (41*b*, 42*b*), assist in increasing the amount of ink that can be stored in the sub-tank 30. In addition to the above, the expanded lower part 42*d* of the second ink room 42 allows the distance between the two ink discharging openings 32 to be increased so that the ink can be introduced into the inkjet head 5 from locations defined at positions close to both ends of the inkjet head 5. in the longitudinal direction thereof.

State of the Ink within the Sub-tank

Hereinafter, the state of the ink within the sub-tank 30 will be described.

When the ink tank 20 is firstly implemented, or when the ink tank 20 is exchanged, the hollow needle 25 on one end of the flexible tube 28 is inserted into a new ink tank 20. In such a case, air enters into the flexible tube 28 through the hollow needle 25. The air moves through the flexible tube 28 and enters the sub-tank 30 as the ink of the new ink tank 20 is initially introduced into the sub-tank 30. The air introduced into the sub-tank 30 accumulates at the upper parts of the first and second ink rooms 41 and 42 as shown in FIGS. 3A through 3C. The volume of the air within the sub-tank 30 is adjusted, by an air discharging purging which is carried out when the ink is initially introduced into the sub-tank 30 from the new ink tank 20, so that the ink levels in the first and second ink rooms substantially coincides with the top surface of the wall 36.

The air accumulated in the upper parts of the first and second ink rooms 41 and 42 serves as an air damper. That is, when an appropriate volume of air is accumulated at the upper parts of the first and second ink rooms 41 and 42, the air can absorb the dynamic pressure generated in the ink within the flexible tube 28 as the carriage 4 reciprocates for printing. As a result, the effect of the dynamic pressure of the ink within the flexible tube 28 on the ink ejection of the inkjet head 5 is reduced and the ink ejection property of the inkjet head 5 becomes stable.

Under a normal condition, the ink level within the sub-tank 30 is maintained as shown in FIGS. 3A through 3C, and each inkjet head 5 ejects ink to print an image on a fabric. When ink is ejected from the inkjet head 5, negative pressure is generated within the ink channel formed in the inkjet head 5. Due to this negative pressure, the ink in the second ink room 42 of the sub-tank-30 flows into the inkjet head 5 through the ink discharging openings 32 and, in turn, the ink in the first ink room 41 flows over the wall 36 and is supplied to the first ink room 41. Further, the ink in the flexible tube 28 flows into the first ink room 41 through the ink introducing channel 43 and the ink of the ink tank 20 flows into the flexible tube 28. In this way, the ink of the ink tank 20 is supplied to the inkjet head 5 by the negative pressure generated in the inkjet head 5. It should be noted that the negative pressure generated in the inkjet head 5 due to the ejection of the ink is not so large. Therefore, the ink level in the sub-tank 30 is kept substantially at the state illustrated in FIGS. 3A through 3C.

FIG. 4A schematically illustrates the state of the ink within the sub-tank 30 after printing or purging is carried out since the air within the sub-tank 30 has increased due to the introduction of ink containing bubbles. FIGS. 4B and 4C are sectional views of the sub-tank 30 taken along lines D-D and E-E in FIG. 4A. respectively.

When the ink introduced into the sub-tank 30 includes bubbles, the volume of the air accumulated in the sub-tank 30 increases and causes the ink level within the sub-tank 30 to be lowered. When the inkjet head 5 ejects ink for printing or purging although the ink level is lowered (i.e., the ink surface is pressed down), the ink level in the second ink room 42 goes down as the ink flows into the inkjet head 5 through the ink discharging openings 32. The ink level in the first ink room 41 rises up to substantially the same level of the top of the wall 36.

If printing is continued with such a condition, it becomes impossible that the ink in the first ink room 41 moves over the wall 36 with the small negative pressure generated in the ink channel of the inkjet head 5.

In such a case, the excessive volume of the air within the sub-tank 30 can be reduced to the normal volume by carrying out the air discharging purging of the inkjet head 5. The air discharging purging generates a large negative pressure in the ink channel of the inkjet head 5. Thus, the ink surface level in the second ink room 42 is further lowered and the ink in the first ink room 41 flows into the second ink room 42. When the ink flows into the second ink room 42, the excessive air within the sub-tank 30 is trapped between the ink in the second ink room 42 and the ink that has flown into the second ink room 42 as shown in FIG. 4A. This excessive air is then discharged from the sub-tank 30 through the inkjet head 5 by further carrying out the air discharging purging of the inkjet head 5.

It should be noted that the sub-tank 30 is designed so that the level of ink (i.e., the ink surface) moves up and down in the upper part 41*b* of the first ink room 41 and the upper part 42*b* of the second ink room 42 when printing or purging is carried out or when bubbles are introduced and accumulated in the sub-tank 30. As previously described, the upper part 41*b* of the first ink room 41 and the upper part 42*b* of the second ink room 42 are formed such that the horizontal sections thereof are constant in the vertical direction. Thus, the area of the ink exposed to the air in the sub-tank 30 does not increase but is kept constant when the levels of the ink in the first and second ink rooms 41 and 42 move up and down due to execution of printing or purging or due to bubbles introduced into the sub-tank 30.

As is also previously described, the upper part 42*b* of the second ink room 42 is formed to have a small horizontal section. This small horizontal section reduces the contact area between the ink surface and the air in the second ink room 42 and, in turn, the coagulation of adhesive materials within the ink when the ink contains any. Since the horizontal section of the upper part 42*b* of the second ink room 42 is constant, or kept small. in the vertical direction, the above mentioned effect is maintained even when the level of ink moves up and down as printing or purging is carried out or the air volume in the sub-tank 30 increases due to introduction of bubbles thereinto.

It should be noted that, while providing the above mentioned effect, the sub-tank 30 can also effectively absorb the pressure variation of the ink, which is generated by the reciprocation of the carriage 4, within the first ink room 41. This is because the upper part 41*b* of the first ink room 41 is designed relatively large so that the air accumulated in the sub-tank contacts a large surface area of the ink in the first ink room 41 to serve as a good air damper.

It should be noted that the configuration of the sub-tank 30 is not limited to that described above.

Hereinafter, variations of the sub-tank 30 will be described with reference to the drawings. When the variations are described, the same reference numbers denotes elements that are substantially the same as those described in FIGS. 1 through 4.

FIG. 5A is a sectional view similar to that shown in FIG. 3A of a sub-tank 100, which is a first variation of the sub-tank 30. FIGS. 5B and 5C are sectional views of the sub-tank 100 taken along lines F-F and G-G in FIG. 5A, respectively.

The sub-tank 100 has a base plate 31 and a rectangular parallelepiped body 100 formed on the base plate 31. Similar to the body 35 of the sub-tank 30, the body 100 has the opening 41*a*, which is covered with the flexible film 45, the connection portion 29, and the ink introducing channel 43. The body 100 also has the ink storing space therein, which is divided into the first and second ink rooms 41 and 42 by a wall 102.

The wall 102 is formed on the base plate 31 and extends perpendicularly to the moving direction of the carriage 4.

As shown in FIGS. 5B and 5C, a first air space 105 is formed above-the first ink room 41 and a-second air space 107 is formed above the second ink room 42.

The second air space 107 is in fluid communication with the second ink room 42 and formed longer than the upper part 42*b* of the second ink room 42 in a direction perpendicular to the reciprocating direction of the carriage 4 (in right and left direction in FIG. 5C). Thus, the second air space 107 has a larger horizontal section than the upper part 42*b* of the second ink room 42.

The first air space 105 is in fluid communication with the first ink room 41. The first air space 105 has substantially the same dimensions as the second air space 107.

A communication channel 103 is formed above the wall 102 through which the first and second air spaces 105 and 107 are in fluid communication with each other. Therefore, the ink stored in the first ink room 41 can flow over the wall 102 and into the second ink room 42.

When ink is introduced into the sub-tank 100 arranged as above, the air introduced into the sub-tank 100 together with the ink accumulates in the first and second air spaces 105 and 107. As in the sub-tank 30, this air serves as an air damper that absorbs the dynamic pressure generated in the ink as the carriage 4 reciprocates. Since the horizontal section of the second air space 107 is larger than that of the upper part 42*b* of the second ink room 42, a large volume of air can be stored therein and hence the variation of the dynamic pressure in the ink within the second ink room 42 can be reduced effectively. It should be noted that, although the first air space 105 is reduced in comparison with the first air space 36 shown in FIG. 4B, the entire air space is increased since the second air space 107 is much larger than the corresponding space shown in FIG. 4C. Therefore, the damper effect is improved in the modification shown in FIGS. 5A-5C. Thus, the ink ejection from the inkjet head 5, is hardly affected by the dynamic pressure variation of the ink in the sub-tank 100, and high printing quality can be maintained.

According to another aspect, the cross section of each of the first and second ink rooms 41 and 42 is configured such that the horizontal section within a range from the top of the wall 102 to a predetermined position below is less than the horizontal section of the lower portion thereof. It should be noted that the horizontal section of the upper part of the first ink room 41 is not so small as that of the corresponding part of the second ink room 42. In order to make the damper effect of the flexible film 45, the length of the upper part of the first ink room 41 in a horizontal direction parallel to the wall 12 is made relatively long.

FIG. 6A is a sectional view similar to that shown in FIG. 3A of a sub-tank 150, which is a second variation of the sub-tank 30. FIGS. 6B and 6C are sectional views of the sub-tank 150 taken along lines H-H and I-I in FIG. 6A, respectively.

The sub-tank 150 has a body 151 formed on the base plate 31. The body 151 has substantially the same configuration as the body 101 shown in FIGS. 5A through 5C except the following points.

Firstly, upper portions of side walls 151*a* and 151*b* of the body 151 are formed thicker than the other portions thereof. Thus, the first and second ink rooms are narrower in the reciprocating direction of the carriage 4 at portions near the top end of the wall 102 than in the sub-tank 100.

Secondly, a side wall of the first ink room 41 facing the wall 102 is formed with an opening 152. The opening 152 is covered, or closed, by a flexible film 153. The opening 152 and the flexible film 153 have smaller sizes than the opening 41*a* and the flexible film 45 of the sub-tank 30, respectively. Except for the above, the configuration and the function of the opening 152 and the flexible film 153 are substantially the same as those of the opening 41*a* and the flexible film 45 of the sub-tank 30.

In the sub-tank 150 configured as above, air remains in the first and second ink space 105 and 107 as ink is initially supplied thereto from the ink tank 20, and serves as an air damper that absorbs the dynamic pressure that occurs in the ink as the carriage 4 reciprocates. If the ink is exposed to the air, coagulation of the adhesive material may occur. However, in the sub-tank 150, since the portions of the first and second ink rooms 41 and 42 near the top edge of the wall 102 are narrow in the reciprocation direction of the carriage 4. the surface area of the ink exposed to the air in the sub-tank 150 is small, and hence the coagulation of the adhesive materials contained in the ink can be reduced.

FIG. 7A is a sectional view similar to that shown in FIG. 3A of a sub-tank 200, which is a third variation of the sub-tank 30. FIGS. 7B and 7C are sectional views of the sub-tank 200 taken along lines J-J and K-K in FIG. 7A, respectively.

The sub-tank 200 has a body 201 formed on the base plate 31. The body 201 has substantially the same configuration as the body 151 shown in FIGS. 5A through 5C except that an opening 202 is formed on the top face of the body 201 so that the first air space 105 and second air space 107 are opened upwardly. The opening 202 is covered, or closed, by a flexible film 203, which is the same as the flexible film 45 except the size.

In the sub-tank 200 arranged as above, the flexible film 203 absorbs the pressure variation transmitted from the ink to the air in the first air space 105 and the second air space 107. Thus. the flexible film 203 enhances the function of the first and second air spaces 105 and 107 as air dampers. As a result. pressure variation of the ink in the first ink room 41 hardly transmits to the ink in the second ink room 42, and hence hardly affects the ink ejection of the inkjet head 5.

FIG. 8A is a sectional view similar to that shown in FIG. 3A of a sub-tank 250, which is a fourth variation of the sub-tank 30. FIGS. 8B and 8C are sectional views of the sub-tank 250 taken along lines L-L and H-N in FIG. 8A, respectively.

The sub-tank 30 includes the base plate 31 and a body 251 formed into a substantially rectangular parallelepiped shape. As with the body 35 of the sub-tank 30. the body 251 of the sub-tank 250 has the connection portion 29 and the ink introducing channel 43. Further, the body 251 has an ink storing space (241, 242) therein for storing the ink supplied from the ink tank 20.

A wall 252 extending perpendicularly to the reciprocating direction of the carriage 4 is formed on the base plate 31 inside the body 251. The wall 252 divides the ink storing space of the body 251 into a first ink room 241 and a second ink room 242 while allowing the first and second ink rooms 241 and 242 to be in fluid communication with each other above the wall 252. Note that the shape of the first and second ink rooms 241 and 242 are substantially the same as the first ink room 41 of the sub-tank 30 (see FIG. 3B). In other words, the lower parts of the first and second ink-rooms 241 and 242 are expanded than the upper parts thereof in order to increase the volume of the ink that can be stored therein.

A recess 253 is formed on the ceiling of the ink storing space of the body 251 at a location opposing the upper edge of the wall 252 as shown in FIG. 8A. The horizontal section of the recess 253 is smaller that that of the portion of the ink storing space of the body 251 at which the first and second ink rooms 241 and 242 are in fluid communication with each other.

Initial introduction of the ink into the sub-tank 250 arranged as above is carried out at a relatively high ink introducing rate. The ink introduced into the sub-tank 250 pushes out, or discharges, the air in the sub-tank 250 and fills not only the first and second ink rooms 241 and 242 but also a lower part of the recess 253 as shown in FIG. 8A. The air still remaining in the recess 253 serves as an air damper that absorbs the pressure variation of the ink within the sub-tank 250 as the carriage 4 reciprocates.

As described herein above, each of the sub-tanks 30, 100, 150, and 200 is arranged such that the upper part 42*b* of the second ink room 42 has smaller horizontal section than the upper part 41*b* of the first ink room 41. Therefore, the surface of the ink in the second ink room 42 that comes in contact with the air within the sub-tank (30, 100, 150, 200) is small, resulting in less coagulation of the adhesive material contained in the ink on exposure to the air and hence less clogging of the inkjet head 5.

In the sub-tank 250, the recess 253 is formed such that the horizontal section thereof is smaller than that of the portion of the sub-tank 250 at which the first and second ink rooms 241 and 242 are in fluid communication with each other. Thus, when the ink is filled into the sub-tank 250 until the ink level is located within the recess 253, the surface of the ink that exposes to the air remaining in the sub-tank 250 is small and hence the coagulation of the adhesive material in the ink can be reduced.

It should be noted that each of the sub-tanks 30, 100, 150, 200, and 250 are provided with a wall (36, 102, 252) within the body (35, 101, 151, 201, 251) thereof. which extends substantially perpendicularly to the reciprocating direction of the carriage 4. The ink surface becomes wavy as the carriage 4 reciprocates, however, the wall (36, 102, 252) keeps the wave small and reduces the froth of the ink. Thus, the sub-tanks 30, 100, 150, 200, and 250 can prevent entrainment of bubbles into the ink, which bubbles may deteriorate the printing quality by making the ink ejection from the inkjet head 5 unstable.

It should be noted that the side wall of the first ink room 41 of each of the sub-tanks 30, 100, 150, and 200 is provided with the flexible film (45, 153). The flexible film is arranged so that it faces the wall (36, 102) formed inside the sub-tank (30, 100, 150, 200) and extends perpendicularly to the reciprocation direction of the carriage 4. The flexible film (45, 153) arranged as above can absorb the dynamic pressure generated in the ink by the reciprocation of the carriage 4. It should be noted that the dynamic pressure can be absorbed effectively when the flexible film (45, 153) is as large as or larger than the wall (36, 102) facing it.

It should also be noted that, since the ink storing space of each of the sub-tanks 30, 100, 150, 200, 250 is divided into two rooms, i.e., the first ink room (41, 250) and the second ink room (42, 242), by the wall (36, 102, 252) formed inside the sub-tank, the structure of each sub-tank (30, 100, 150, 200, 250) is simple and can be produced in low cost.

While the invention has been described in detail with reference to specific embodiments thereof, it would be apparent to those skilled in the art that various changes and modifications may be made therein without departing from the spirit of the invention, the scope of which is defined by the attached claims.

For example, the number of ink rooms to be defined in the ink storing space of each of the sub-tanks 30, 100, 150, 200 is not limited to two but may be more than two. In this case, one ink room is connected with the ink introducing channel. Further, at least one of the other ink rooms is formed to have an upper part of which horizontal section is smaller than that of an upper part of the ink room connected with the ink introducing channel so that the ink introduced into the at least one of the other ink rooms is exposed to the air only at a small surface.

Similarly, the number of ink rooms to be defined in the ink storing space of the sub-tank 250 is not limited to two but may be more than two.

Further, the wall (36, 102, 252) inside the sub-tank (30, 100, 150, 200, 250) may be formed in parallel with the reciprocating direction of the carriage 4.

Further, the flexible film (45, 153) attached on the side wall of the first ink room (41) of the sub-tank (30, 100 150, 200) is not essential and may be omitted.

The present invention can be applied not only to the inkjet printer 1 shown in FIG. 1 but to any other inkjet printers in which one type of the sub-tanks 30, 100, 150, 200, 250 described above can be provided on the inkjet head which is in turn mounted on a reciprocating carriage to print on a recording medium a desired image. Note that the recording medium is not limited to fabric but includes plastics sheets, paper sheets, or the like.

The present disclosure relates to the subject matter contained in Japanese Patent Application No. P2003-84514, filed on Mar, 26, 2003, which is expressly rated herein by reference in its entirety.

What is claimed is:

1. An inkjet printer printing an image on a recording medium which is fed in a first direction, comprising:

an inkjet head that is driven to eject ink to a recording medium;

a carriage mounting the inkjet head, the carriage being reciprocally movable in a second direction which is perpendicular to the first direction;

a movable ink tank that is mounted on the carriage, the movable ink tank having an ink storing chamber having top and bottom inner surfaces, and oppositely positioned inner side surfaces, the movable ink tank having an ink introducing channel and an ink discharging opening, ink supplied through the ink introducing channel being stored in the ink storing chamber, the ink stored in the ink storing chamber being discharged through the ink discharging opening to the inkjet head, wherein the ink storing chamber is oriented length wise in the first direction;

at least one wall provided in the ink storing chamber, the at least one wall extending vertically from the inner bottom surface towards the top inner surface along the first direction to divide the ink storing chamber into a plurality of rooms, the at least one wall extending the length of the ink storing chamber along the first direction and contiguous with the oppositely positioned inner side surfaces perpendicular to the first direction, the plurality of rooms communicating with each other at an upper portion thereof which is above an upper end of the at least one wall when in use;

wherein one of the plurality of rooms is a first room being provided with the ink introducing channel, and one of the plurality of rooms other than the first room is a second room being provided with the ink discharging opening; and wherein each room of the plurality of rooms other than the first room has a cross-sectional area in the second direction within a predetermined vertical range less than the first room, the predetermined vertical range is the distance from the top end of the at least one wall to the top inner surface of the ink storing chamber.

2. The inkjet printer according to claim 1, wherein the at least one room other than the first room has a cross-sectional area below the predetermined vertical range measured in the second direction and from the upper end of the at least one wall to inner bottom surface of the ink storing chamber of the movable ink tank greater than the cross-sectional area within the predetermined vertical range measured in the second direction and from the upper end of the at least one wall to the top inner surface of the ink storing chamber.

3. The inkjet printer according to claim 2, wherein cross-sectional areas within the predetermined vertical range of the plurality of the rooms other than the first room measured in the second direction and from the upper end of the at least one wall to the top inner surface of the ink storing chamber are equal to or smaller than the cross-sectional area within the predetermined vertical range of the first room.

4. The inkjet printer according to claim 3, wherein the cross-sectional areas below the predetermined vertical range of the plurality of the rooms other than the first room measured in the second direction and from the upper end of the at least one wall to the bottom inner surface of the ink storing chamber are greater than the cross-sectional areas within the predetermined vertical range of the plurality of the rooms other than the first room.

5. The inkjet printer according to claim 2, wherein at least one room of the plurality of the rooms other than the first room has a vertical range, in the vicinity of the upper end of the at least one wall, in which the cross-sectional area in the second direction is fixed.

6. The inkjet printer according to claim 2, wherein the at least one second room has a vertical range, below the predetermined vertical range, in which the cross-sectional area in the second direction increases toward a lower portion thereof.

7. The inkjet printer according to claim 2, wherein at least one of the plurality of the rooms other than the first room has a vertical range, above the upper end of the at least one wall, in which a cross-sectional area in the second direction is greater than that in the predetermined vertical range.

8. The inkjet printer according to claim 2, further comprising:

a stationary ink tank which does not move when the carriage moves; and a tube member that connects the stationary ink tank and the movable ink tank to allow the ink to be supplied from the stationary ink tank to the movable ink tank.

9. The inkjet printer according to claim 2, wherein each of the at least one wall has a portion extending in directions substantially perpendicular to the first direction.

10. The inkjet printer according to claim 9, wherein a portion of a side wall of the first room facing the portion extending in directions substantially perpendicular to the first direction is formed with flexible material.

11. The inkjet printer according to claim 2, wherein the at least one wall consists of a single wall, the ink chamber being divided into two rooms by the single wall.

12. The inkjet printer according to claim 1, wherein a cross-sectional area in the second direction of the first room below the predetermined vertical range is greater than the cross-sectional area in the second direction thereof within the predetermined vertical range.

13. The inkjet printer according to claim 12, wherein the first room has a vertical range, in the vicinity of the upper end of the at least one wall, in which the cross-sectional area in the second direction is fixed.

14. The inkjet printer according to claim 12, wherein the first room has a vertical range, below the predetermined vertical range, in which the cross-sectional area in the second direction increases toward a lower portion thereof.

15. The inkjet printer according to claim 12, wherein the first room has a vertical range, above the upper end of the at least one wall, in which a cross-sectional area in the second direction is greater than that in the predetermined vertical range.

16. The inkjet printer according to claim 12, further comprising:

a stationary ink tank which does not move when the carriage moves; and a tube member that connects the stationary ink tank and the movable ink tank to allow the ink to be supplied from the stationary ink tank to the movable ink tank.

17. The inkjet printer according to claim 12, wherein each or the at least one wall has a portion extending in directions substantially perpendicular to the first direction.

18. The inkjet printer according to claim 17, wherein a portion of a side wall of the first room facing the portion extending in directions substantially perpendicular to the first direction is formed with flexible material.

19. An inkjet printer printing an image on a recording medium which is fed in a first direction, comprising:

an inkjet head that is driven to eject ink to a recording medium;

a carriage mounting the inkjet head, the carriage being reciprocally movable in a second direction which is perpendicular to the first direction;

a movable ink tank that is mounted on the carriage, the movable ink tank having an ink storing chamber having top and bottom inner surfaces, and oppositely positioned inner side surfaces, the movable ink tank having an ink introducing channel and an ink discharging opening, ink supplied through the ink introducing channel being stored in the ink storing chamber, the ink stored in the ink storing chamber being discharged through the ink discharging opening to the inkjet head, wherein the ink storing chamber is oriented lengthwise in the first direction; and at least one wall provided in the ink storing chamber, the at least one wall extending vertically to divide the ink storing chamber, in the first direction, the at least one wall extending the length of the ink storing chamber along the first direction and contiguous with the oppositely positioned inner side surfaces perpendicular to the first direction, into plurality of rooms, the plurality of rooms communicating with each other at an upper portion of the ink storing chamber which is above an upper end of the at least one wall when in use, wherein the upper portion of the ink storing chamber includes a first vertical range above the upper end of the at least one wall and a second vertical range above the first vertical range, a cross-sectional area in the second direction in the second vertical range is smaller than that in the first vertical range.

20. An inkjet printer printing an image on a recording medium which is fed in a first direction, comprising:

an inkjet head that is driven to eject ink to a recording medium;

a carriage mounting the inkjet head, the carriage being reciprocally movable in a second direction which is perpendicular to the first direction;

a movable ink tank that is mounted on the carriage, the movable ink tank having an ink storing chamber having top and bottom inner surfaces, and oppositely positioned inner side surfaces, the movable ink tank having an ink introducing channel and an ink discharging opening, ink supplied through the ink introducing channel being stored in the ink storing chamber, the ink stored in the ink storing chamber being discharged through the ink discharging opening to the inkjet head, wherein the ink storing chamber is oriented length wise in the first direction; and at least one wall provided in the ink storing chamber, the at least one wall extending vertically to divide the ink storing chamber, the at least one wall extending the length of the ink storing chamber alone the first direction and contiguous with the oppositely positioned inner side surfaces perpendicular to the first direction, in the horizontal direction, into a plurality of rooms, the plurality of rooms communicating with each other at an upper portions which is above an upper end of the at least one wall when in use, one of the plurality of rooms being provided with the ink introducing channel; and wherein a cross-sectional area in the second direction of at least one of the plurality of rooms within a predetermined vertical range from the upper end of the at least one wall is less than that at range below the predetermined vertical range.

* * * * *